United States Patent [19]
Wappler
[11] 4,256,337
[45] Mar. 17, 1981

[54] UNIVERSAL FORK ASSEMBLY

[76] Inventor: Joachim H. R. Wappler, 317 Kenollie Rd., Mississauga, Ontario, Canada

[21] Appl. No.: 67,381

[22] Filed: Aug. 17, 1979

[51] Int. Cl.³ ..... B67C 1/00
[52] U.S. Cl. ..... 294/67 A; 414/722; 414/723
[58] Field of Search ..... 294/67 A, 67 R, 67 AA, 294/67 AB, 63 R, 82 R, 103 CG; 414/722, 723, 785

[56] References Cited

U.S. PATENT DOCUMENTS

| | | | |
|---|---|---|---|
| 732,884 | 7/1903 | Normandin | 294/67 A |
| 3,066,968 | 12/1962 | Brooks | 294/67 A |
| 3,851,779 | 12/1974 | Crawford | 414/785 |

FOREIGN PATENT DOCUMENTS

| | | | |
|---|---|---|---|
| 1193121 | 5/1970 | United Kingdom | 294/67 A |

*Primary Examiner*—James B. Marbert

[57] ABSTRACT

A universal lifting fork assembly, for lifting a load of product and having tine members, mounted in spaced apart location, for insertion under a load, side frame means with the tine members mounted on the frame means, and being movable to provide different spacings between the tine members, a column member extending upwardly from the frame and being extendible and rectractable to vary its length, fastening means in the column to secure the same at a predetermined adjusted length, a balance bar connected to the upper end of the column means, and extending outwardly to one side, and, adjustable hoist attachment means on the balance bar having locking means, whereby it may be locked in a predetermined adjusted position to center over a load.

9 Claims, 8 Drawing Figures

UNIVERSAL FORK ASSEMBLY

The invention relates to a lifting fork apparatus for use in association with hoists.

BACKGROUND OF THE INVENTION

Industrial handling of a wide variety of goods such as building materials, machinery and packaged goods, usually employ the use of palettes of wood, metal or plastic which provides a stable base for the goods. In addition, such palettes provide a space beneath the goods so that they may more readily be lifted by a hoist to be transported.

In some cases, such palettes are not necessary. Stacks of product, eg. building blocks, define horizontal passageways for lifting on a hoist, and are sufficiently stable to be stacked without palettes. Such palettes and stacks will vary in size and also in design. They will usually provide narrow passageways through which separate prongs of a fork-like lifting device may be inserted. Variations exist in different palettes or products and the spacing between such passageways differs. It has been proposed to provide lifting forks with a capability for varying the spacing between the individual prongs. In this way, one lifting fork assembly can be used to lift various different types of palettes.

In addition to this problem, however, the size and shaping of the various loads carried on such palettes is subject to wide variation. Lifting forks of this type are used on lifting cables and it is essential that the load will be more or less balanced or centred beneath the axis of the cable.

The general design of such lifting forks of this type, employs a number of more or less horizontal prongs, attached to some sort of vertical frame work adapted to extend upwardly on one side of the palette.

In order to balance the load beneath a hoisting cable, a generally L-shaped balance bar is provided attached to the upper end of the vertical framework, so that the hoist cable may be attached more or less centrally with regard to the load.

Where the load on the palette will always be the same height and shape, then the vertical framework and the balance bar can be designed specifically to suit the load.

Changes in the size or shape of the load, would however, require the actual lifting fork to be changed to accommodate it and may require changes in the balance bar.

It is therefore a general objective of the invention to provide a universal lifting fork, in which both the spacing between the prongs may be varied to suit different types of product or palette, and in which the height of the side frame may be varied, and also in which the length of the balance bar may also be effectively changed, so as to suit different products or palettes, and loads on such palettes of varying shapes, by a system of adjustments incorporated in the lifting fork itself.

More particularly, it is an objective of the invention to provide a universal lifting fork with a plurality of lifting prongs arranged on a generally horizontal support means, with such lifting prongs being moveable along such support means.

More particularly, it is an objective of the invention to provide such a universal lifting fork in which the side frame incorporates a single column portion, with adjustment means incorporated in such column portion whereby the same may be extended or retracted to vary the height of the frame.

More particularly, it is an objective of the invention to provide such a universal lifting fork assembly in which the L-shaped balance bar is provided with a slideable attachment means for interconnection to a hoisting cable, and means for locking such slideable attachment means in a variety of different positions, thereby effectively varying the length of the balance bar for purposes of balancing the load.

The various features of novelty which characterize the invention are pointed out with particularity in the claims annexed to an forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
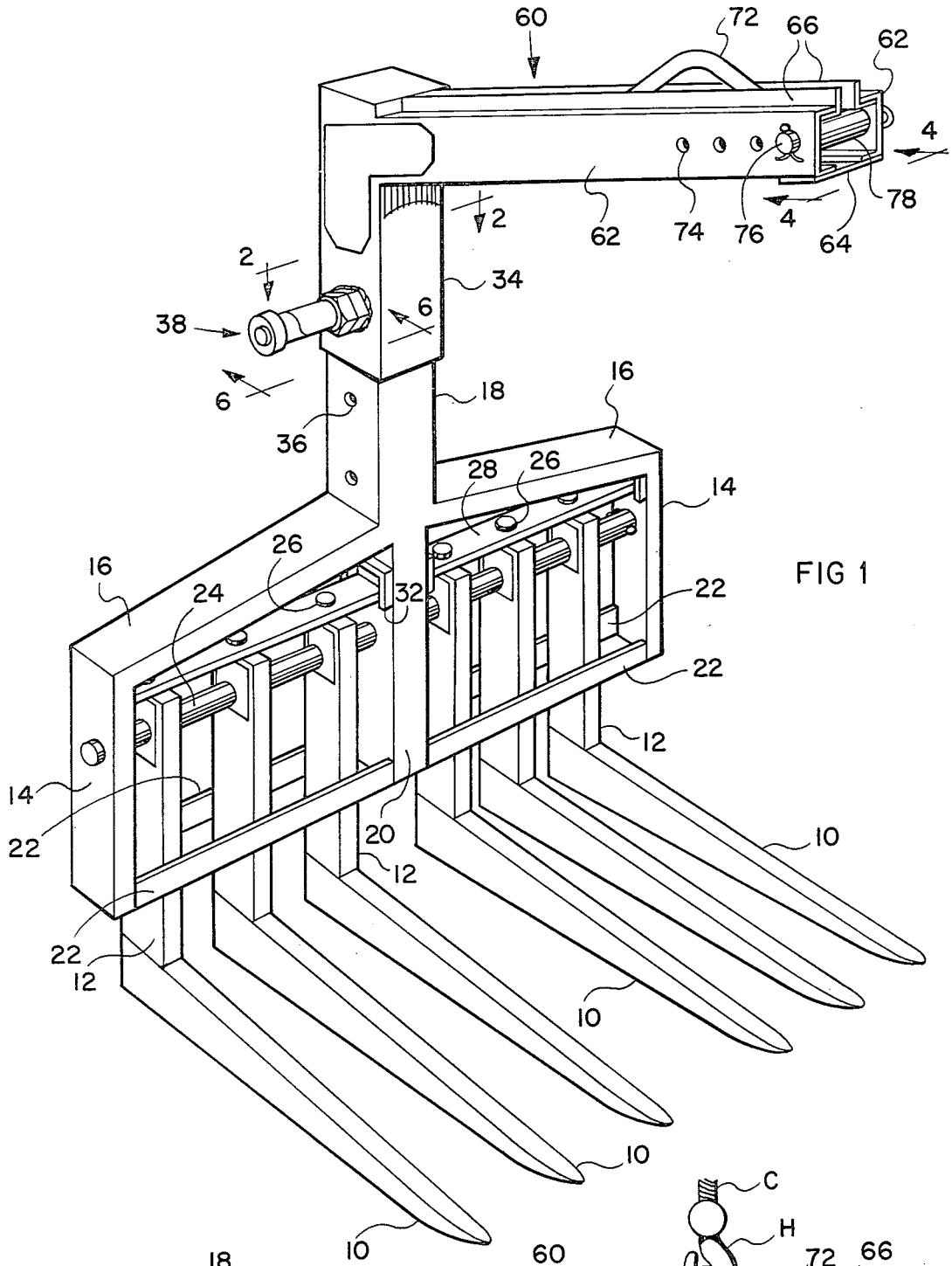
FIG. 1 is a perspective illustration of a lifting fork according to the invention.

The preferred embodiment of the invention as illustrated, will be seen to comprise a plurality of lifting prongs or tines 10, of generally L-shaped design, arranged in a spaced apart manner so that they may be slid beneath a stack of product (not shown). The tines 10, incorporate upwardly extending arms 12, attached thereto more or less in a right-angular manner giving them the shape of the letter L as described.

In order to support them in the relationship as shown, a generally C-shaped yoke or frame is provided, consisting of opposed vertical side members 14, and inwardly extending angled cross members 16. The inward ends of the cross members 16 are rooted to a central vertical tubular post member 18.

A central, or intermediate support bar 20 extends downwardly, intermediate the two side members 14, coaxial with the tubular post member 18.

The intermediate support member 20 and the side members 14 are joined along their front and rear edges by means of spaced apart parallel guide bars 22.

The arm portions 12 of the tines 10 extend upwardly, between guide bars 22, into the spaces between side members 14 and the central support member 20.

At their upper ends, the arms 12 are slideably fastened on a transverse mounting rod 24 which passes through side members 14 and through the central support member 20.

Arms 12 are provided with suitable opening whereby they may be slideably received on the support rod 24, and be slideable transversely therealong, so as to vary the space in between the tines 10 and arms 12.

Suitable reinforcements may be provided on either side of the arms 12, depending upon the materials used and the loads intended for use with the fork.

Figure 8:
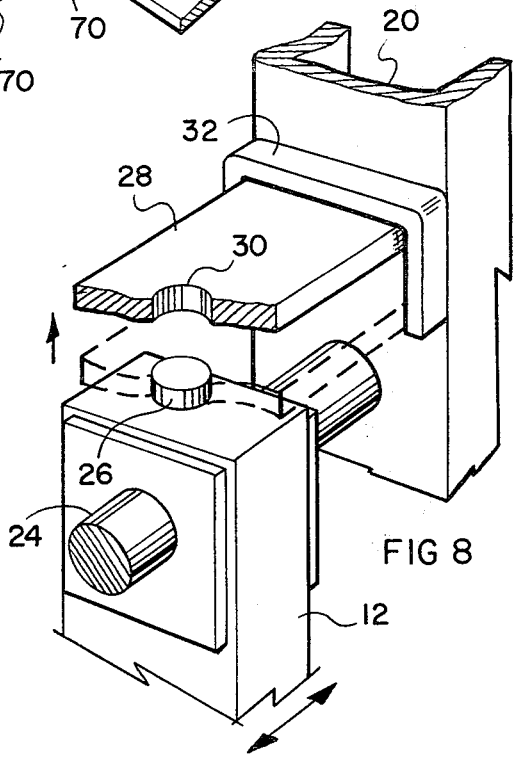

Each of the arms 12 is provided with an upwardly extending boss 26, which are provided for co-operating with the moveable locking bars 28 (see FIG. 8).

Locking bars 28 are vertically moveable relative to the bosses 26 and are provided with holes 30 for receiving such bosses therein in interlocking relation.

At either end of the bars 28, there are provided generally three-sided rectangular end guide structures 32, which are mounted on the inwardly directed faces of side members 14, and on both faces of the centre support member 20. The locking bars 28 are vertically moveable in the end guides 32, so that they can be moved upwardly and downwardly relative to the bosses 26.

With the locking bars 20 in their lower position, the bosses 26 are held in a predetermined spaced apart relationship. However once the locking bars 28 are raised, then the arms 12 can be slid transversely along the rod 24, so as to take up a different spacing.

The locking bars 28 are shown only with the same number of holes as there are bosses 26 and tines 10.

In this form, the tines 10 are of course capable of being actually locked only in one position.

However with the locking bars raised, the tines 10 can be moved to any other position where it is necessary.

The invention does not however exclude the possibility of providing locking bars 28 with more holes 30, so that the tines 10 could be actually locked in several different positions. Alternatively some other form of tine locking mechanism could be provided, in which a greater number of positions could be selected.

Figure 2:
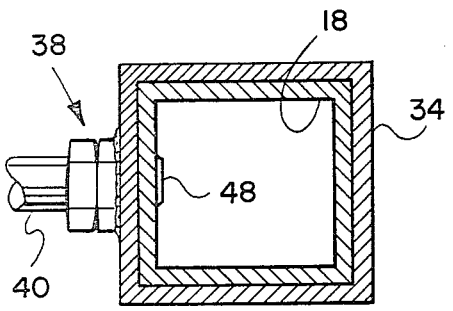
FIG. 2 is a section along line 2—2 of FIG. 1.
Figure 3:
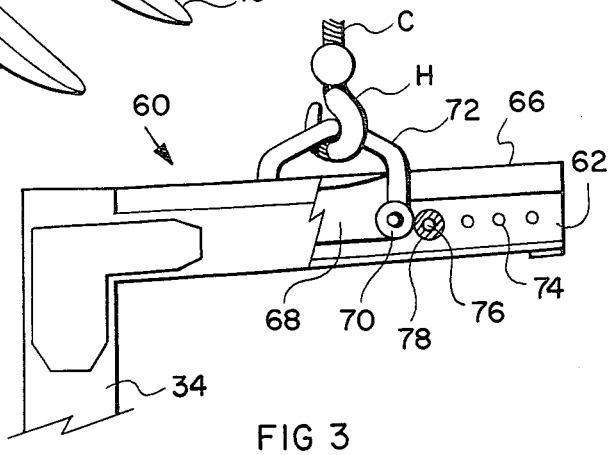
FIG. 3 is a side elevation of the balance bar partially cut away.
Figure 5:
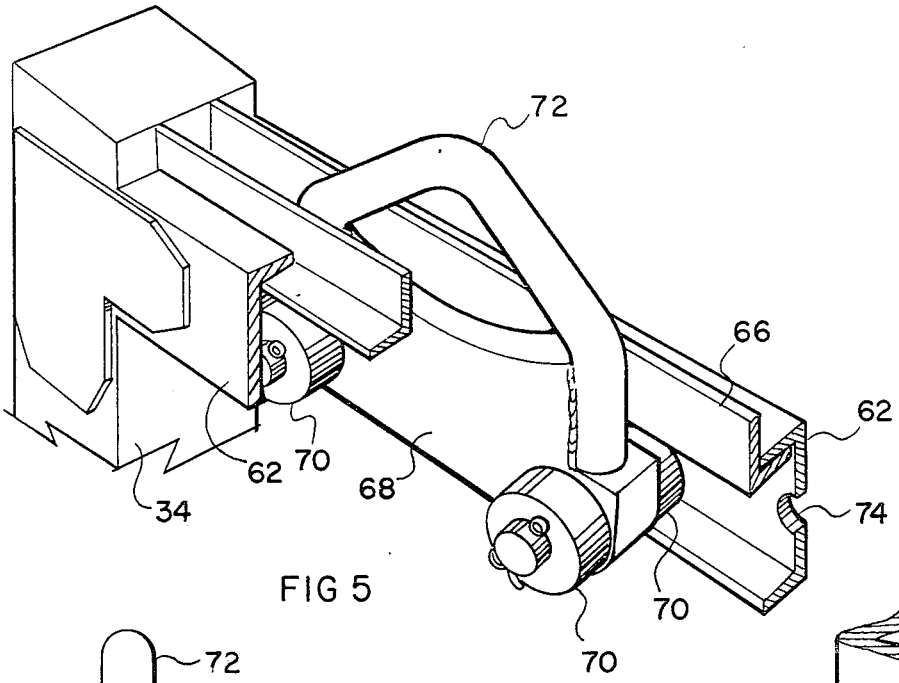
FIG. 5 is a perspective view of the balance bar partially cut away.
Figure 4:
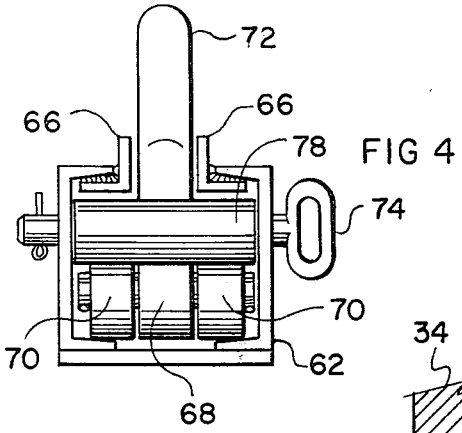
FIG. 4 is an end view of the balance bar viewed from the point 4—4 of FIG. 1.

The vertical or centre post 18, is of generally hollow rectangular construction (see FIG. 2) and is telescopically received within a similar but larger generally rectangular hollow tubular post 34.

The telescopic relationship between members 18 and 34 provides a means of adjusting to loads of different heights.

This is achieved by means of a series of holes 36 formed in one side wall of the post 18, and a spring-loaded releasable locking pin indicated generally as 38, attached to the side wall of post 34.

Figure 6:
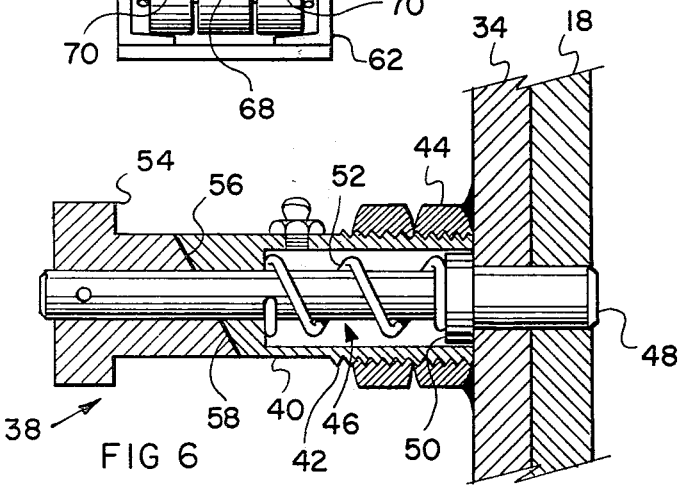
FIG. 6 is a section along the line 6—6 of FIG. 1, showing the components of one position.
Figure 7:
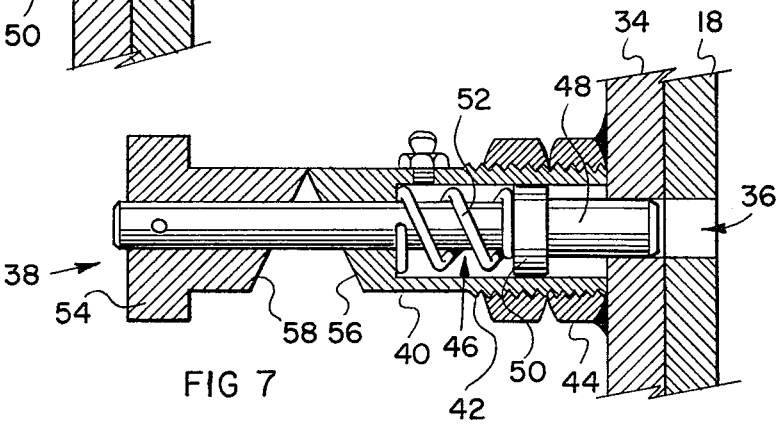
FIG. 7 is the same section of FIG. 6, showing the components in another position, and, FIG. 8 is a perspective partially cut away.

As shown in more detail in FIGS. 6 and 7, the locking pin 38 comprises a hollow body portion 40 having exterior threads 42 by means of which it is threadedly secured in the nut 44 welded to the post 34.

A counter bore 46 within the body 40 receives a locking pin 48, having a bearing collar 50 secured thereto, slideably fitting within the counter bore 46.

A spring 52 fits around the pin 48, being trapped thereon by means of the collar 50.

Pin 48 extends through a reduced diameter bore in the outer end of the body 40, and extends into an operating knob 54, within which it is secured for example by means of a suitable locking pin or the like.

The outer end of body 42 is provided with an angled face 56, and a similar but oppositely angled face 58 is provided on the inward end of the knob 54.

In this way, by rotation of knob 54 through an angle of 180°, the two faces 56 and 58 will react against one another, as shown in FIG. 7, causing withdrawal of the pin 48 from one of the holes 36 in post 18.

In this way, a single operator may perform the necessary adjustments, without having to hold the knob 54 in one hand.

At the upper end of the post 34, a generally L-shaped balance bar 60 is provided.

The balance bar 60 is arranged at a slight angle, upwardly from the horizontal for reasons to be described.

The bar 60 is formed of two parallel channel sections 62 arranged face to face with one another, and secured at their outer ends by means of a plate 64.

Along the channels 62-62-R secured in spaced apart relationship so that they define upper and lower slotted openings. Along the edges of the upper slotted opening, two angle bar members 66 are provided, with inwardly facing vertical guiding faces.

Within the hollow interior of the channels 62, there is provided a moveable trolley member 68, having rollers 70 at either end thereof, and an upwardly extending rod 72 forming an eye, into which the hook H of a lifting cable C can be inserted.

The trolley 68 is moveable to and fro along the balance bar 60, within the confines of channels 62—62.

At the free upper end of balance bar 60, there are a plurality of spaced apart holes 74 formed in registration with one another in respective channels 62—62. A moveable locking bolt 76, having a sleeve 78 thereon may be fastened in any one of the pairs of holes 74. In this way, the upper limit of movement of the trolley 68 is restricted, thereby effectively shortening or lengthening the length of the balance bar 60.

Due to the upward angling of the balance bar 60 the trolley 68 will always be drawn up against the sleeve 78, when the cable C is tight. It can of course run back down the bar 60 when the cable C is slack.

The operation of the invention is self-evident.

Tines 10 can be adjusted to suit any arrangement of openings in either a stack of product or a palette, simply by raising the bars 28 and moving the tines 10 laterally.

The height of the balance bar 60 above the load can be adjusted by extending or retracting the posts 18 and 34, and operation of the locking pin assembly 38 as described above.

The centering of the hoist cable over the centre of the load can also be achieved by simply moving the location of pin 76 down or up the balance bar 60, thus shortening or lengthening the effective length of the balance bar 60.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A universal fork assembly, for lifting a load of product, said fork assembly comprising;

frame means having side members and at least one cross member joining the same into a generally C-shaped structure;

tine members, mounted in spaced apart location for insertion under said load, said tine members mounted between said side frame means in spaced apart location, and being movable relative thereto, and relative to one another, to provide a different spacing between said tine members;

guide bar means extending across said frame means between said side members for guiding and restraining said tine members;

a column member extending upwardly from said frame means, said column means being extendible and retractable whereby to vary its length;

fastening means in said column whereby to secure the same at a predetermined adjusted length;

a balance bar connected to the upper end of said column means, and extending outwardly therefrom to one side thereof over said tine members, and, adjustable hoist attachment means on said balance bar, and having locking means, whereby the same may be locked in a predetermined adjusted position, whereby to center said fastening means over a load supported on said tine members.

2. A universal fork assembly as claimed in claim 1 wherein said frame means comprises two side members, and an intermediate member arranged in parallel spaced apart location, extending in an essentially vertical plane, an upper cross member joining said side members and said intermediate member and being joined to the base of said column means, and rod means extending between and supported by said side members and said intermediate member, said tine members being of generally L-shaped construction, with an upright portion thereof being slidably mounted on said rod means and said guide bar means engaging said upright portions of said tine members. being slidably mounted on said rod means.

3. A universal fork assembly as claimed in claim 2 including locking bar means interengageable with said tine members to hold the same in at least one predetermined location on said rod means.

4. A universal fork assembly as claimed in claim 3 wherein said tine members comprise generally horizontal prong portions, and vertical support portions, said horizontal and vertical portions together forming a generally L-shaped structure, with the upper ends of said L-shaped structures slidably received on said rod means, as aforesaid.

5. A universal fork assembly as claimed in claim 4 wherein said locking means comprises at least two locking bars, guide means for movably locating said locking bars, said guide means being mounted on said side members and said intermediate member, and receiving opposite ends of said locking bars, and boss members on the upper ends of said tine members, and holes in said locking bars for receiving said boss members, thereby locating the same in predetermined locations.

6. A universal fork assembly as claimed in claim 5 including two guide bars extending between the lower ends of said side members and said intermediate member, on opposite sides of said tine members engaging said upright portions of said tin members on opposite sides thereof whereby to secure the same against swinging relative to said side members and said intermediate member.

7. A universal fork assembly as claimed in claim 1 wherein said column means comprises a lower column portion having its lower end attached to said cross bars and said intermediate member, and having an upper column portion with its upper end attached to said balance bar, and said lower and upper column portions being telescopically movable relative to one another, whereby one of said portions slides within the other of said portions, and including locking means on said other of said portions, which is removably insertable into openings formed into said one of said portions.

8. A universal fork assembly as claimed in claim 7 including spring means normally urging said locking means into its locking engagement, and manually operable latching means for unlatching said locking means and holding the same in its unlatched position.

9. A universal fork assembly as claimed in claim 1 wherein said balance bar comprises opposed channel members defining an elongated upwardly directed slotted recess, a trolley member slidably received within said channels, and having an eye portion extending upwardly through said recess and locking means interengageable with said channel means, whereby to limit sliding of said trolley member in one direction.

* * * * *